US007404492B2

(12) United States Patent
Kucher et al.

(10) Patent No.: US 7,404,492 B2
(45) Date of Patent: Jul. 29, 2008

(54) SEPARATION OF FIBRE PULP SUSPENSIONS CONTAINING RELATIVELY HEAVY CONTAMINANTS

(75) Inventors: Valentina Kucher, Grödinge (SE); Jan Backman, Järfälla (SE)

(73) Assignee: GLV Finance Hungary KFT, Luxembourg (LU)

( * ) Notice: Subject to any disclaimer, the term of this patent is extended or adjusted under 35 U.S.C. 154(b) by 23 days.

(21) Appl. No.: 11/125,250

(22) Filed: May 10, 2005

(65) Prior Publication Data

US 2006/0243646 A1 Nov. 2, 2006

(51) Int. Cl.
*B04C 5/13* (2006.01)
*B04C 7/00* (2006.01)

(52) U.S. Cl. ..... 209/730; 209/725; 209/726; 209/728; 209/208

(58) Field of Classification Search ..... 209/730, 209/729, 728, 727, 726, 725, 208
See application file for complete search history.

(56) References Cited

U.S. PATENT DOCUMENTS 2,648,433 A * 8/1953 Fitch et al. ..... 209/726
2,816,490 A * 12/1957 Boadway et al. ..... 96/195
3,052,361 A * 9/1962 Whatley et al. ..... 210/512.2
3,417,871 A * 12/1968 Arnold ..... 210/512.1
3,687,286 A * 8/1972 Weiss ..... 209/135
3,928,186 A * 12/1975 Zemanek ..... 209/729
4,224,143 A * 9/1980 Liller ..... 209/727
4,755,295 A * 7/1988 Donhauser et al. ..... 210/512.2
6,223,904 B1 * 5/2001 Stephan et al. ..... 209/3
6,238,579 B1 * 5/2001 Paxton et al. ..... 210/787
6,284,096 B1 * 9/2001 Hartmann ..... 162/55
2002/0011318 A1 * 1/2002 Jong ..... 162/55
2003/0201213 A1 * 10/2003 Bolles et al. ..... 209/725
2006/0163153 A1 * 7/2006 Caldelman ..... 210/512.1
2006/0243646 A1 * 11/2006 Kucher et al. ..... 209/730

FOREIGN PATENT DOCUMENTS

SE 357680 7/1973

* cited by examiner

*Primary Examiner*—Patrick Mackey
*Assistant Examiner*—Terrell H Matthews

(57) ABSTRACT

A hydrocyclone unit for separating a fibre pulp suspension containing relatively heavy contaminants has an elongate tapering separation chamber, an inlet member that feeds the suspension tangentially into the separation chamber at a base end, so as to form a vortex in the separation chamber, a reject fraction outlet at the apex end of the separation chamber for discharging a reject fraction containing heavy contaminants, and a central accept fraction outlet at the base end for discharging a central fraction containing fibres. A fluid injection member is adapted to inject a fluid tangentially into the separation chamber at a distance from the apex end which is at least 40% of the length of the separation chamber, such that the injected fluid increases the rotational speed of a portion of the vortex in the chamber to increase the separation efficiency with respect to fibres existing in the vortex portion.

24 Claims, 4 Drawing Sheets

SEPARATION OF FIBRE PULP SUSPENSIONS CONTAINING RELATIVELY HEAVY CONTAMINANTS

FIELD OF THE INVENTION

The present invention relates to a hydrocyclone unit and method for separating a fibre pulp suspension containing relatively heavy contaminants.

BACKGROUND OF THE INVENTION

Hydrocyclones are used in the pulp and paper making industry for cleaning fibre pulp suspensions from contaminants, in particular but not exclusively from contaminants that differ from fibres in density. An important application is cleaning from contaminants in the form of heavy weight particles of a specific gravity greater than that of fibres, such as specks, shives, sand and metal particles in the size range of 100-1000 microns. The separation chamber of a conventional hydrocyclone designed for such an application normally has a diameter at the suspension inlet member smaller than about 150 mm to create centrifugal forces strong enough to pull the heavy contaminants radially outwardly in the vortex. The tapering design of the separation chamber is necessary to maintain the rotational speed of the vortex and, consequently, the required magnitude of the centrifugal forces acting on the heavy contaminants along the separation chamber, so that the separation efficiency is satisfactory throughout the separation chamber. In addition, maintaining the speed of the vortex is particularly important when cleaning high consistency fibre suspensions to prevent formation of fibre network. Such a fibre network negatively affects the separation efficiency and could plug the relatively small axial opening at the apex end of the separation chamber. Since the tendency of fibre network formation increases with increasing fibre concentration, the conventional hydrocyclone is normally used for separating fibre suspensions having a fibre concentration of up to 1.0%, in exceptional cases up to 1.5%.

A plurality of hydrocyclones of the conventional type coupled in parallel and forming a first separation stage has been employed in a conventional hydrocyclone plant to achieve the necessary total capacity for cleaning the large suspension flows, typically between 40 000 and 200 000 litres/minute, that often exist in the paper making industry. The conventional hydrocyclone plant also includes further separation stages of hydrocyclones of the conventional type, typically there are four to five stages coupled in cascade, to recover fibres from the reject fraction of the suspension developed in the first stage, whereby the separation efficiency of the plant is increased.

It is known to provide a hydrocyclone with a fluid injection member for injecting a flushing liquid into the separation chamber close to the vicinity of the reject fraction outlet to flush the thickened reject fraction so that fibres are released from the heavy contaminants and plugging of the reject outlet is prevented.

BRIEF SUMMARY OF THE INVENTION

The object of the present invention is to provide a hydrocyclone unit for separating a fibre pulp suspension containing relatively heavy contaminants, which has an increased production capacity, lower energy consumption and enhanced separation efficiency as compared with the conventional hydrocyclone described above.

Accordingly, the present invention provides a hydrocyclone unit for separating a fibre pulp suspension containing relatively heavy contaminants, the hydrocyclone unit comprising a housing forming an elongate tapering separation chamber having a base end and an apex end, at least one suspension inlet member on the housing designed to feed the suspension to be separated tangentially into the separation chamber at the base end thereof, such that the incoming suspension forms a vortex, in which the heavy contaminants are pulled by centrifugal forces radially outwardly and the fibres are pushed by drag forces radially inwardly, whereby a central fraction of the suspension substantially containing fibres is created centrally in the vortex and a reject fraction containing heavy contaminants and some fibres is created radially outwardly in the separation chamber, a reject fraction outlet at the apex end of the separation chamber for discharging the reject fraction, a central accept fraction outlet at the base end of the separation chamber for discharging the central fraction, and at least one fluid injection member for injecting a fluid into the separation chamber, wherein the fluid injection member injects the fluid tangentially into the separation chamber at a distance from the apex end of the separation chamber which is at least 40% of the length of the separation chamber such that the injected fluid increases the rotational speed of a portion of the vortex in the separation chamber to increase the separation efficiency with respect to fibres existing in said vortex portion.

When comparing the hydrocyclone unit of the invention with a conventional hydrocyclone having the same diameter of the separation chamber at the base end, it will be seen that the new hydrocyclone unit can be designed substantially longer than the conventional hydrocyclone, thanks to the above described fluid injection arrangement in accordance with the present invention. This gives the advantage that the residence time of the suspension passing through the long hydrocyclone unit is increased, whereby the overall separation efficiency of the hydrocyclone unit is improved. In addition, the fluid injected by the injection member dilutes the suspension that enters the second separation chamber and thereby counteracts formation of plugging fibre network. This makes possible feeding the new hydrocyclone unit with a fibre suspension of a higher fibre concentration, i.e. at least up to 2.0% or possibly higher.

For example, an increase in fibre concentration from 1.0% to 2.0% results in a reduction by more than 50% of the flow through a multi-stage hydrocyclone plant in which at least the first stage is equipped with hydrocyclone units of the present invention. The reduced flow in turn results in that the number of hydrocyclone units in the first stage can be reduced accordingly. Since the rejects rates in the first stage also are reduced, fewer subsequent stages of possibly conventional hydrocyclones are required. In this example, the number of hydrocyclones in the subsequent stages can be considerably reduced.

Thus, the ability of the hydrocyclone unit of the invention to operate at elevated fibre concentrations combined with lower reject rates than that of conventional hydrocyclones means smaller footprints, less piping, fewer pumps and smaller auxiliary equipment for a new hydrocyclone plant equipped with hydrocyclone units of the present invention. In addition, the energy consumption for the operation of the new plant will be significantly lower. As a result, the investment and operating energy costs for the new plant is significantly reduced, as compared with a conventional plant.

In accordance with a preferred embodiment of the invention, the housing forms a first elongate generally tapering chamber section of the separation chamber extending from the base end of the separation chamber to an apex end of the first chamber section having an axial opening and a second elongate generally tapering chamber section of the separation chamber extending from a base end thereof having an axial opening to the apex end of the separation chamber. The first chamber section communicates with the second chamber section, such that the vortex formed in the separation chamber during operation extends from the first chamber section through the axial opening of the apex end of the first chamber section and the axial opening of the base end of the second chamber section into the second chamber section. The fluid injection member is designed to inject the fluid tangentially into the second chamber section at the base end thereof to increase the rotational speed of a portion of the vortex existing in the second chamber section.

In the preferred embodiment, the length of the second chamber section is at least 60%, preferably at least 70% of the length of the first chamber section, to achieve a long residence time of the suspension flowing through the separation chamber of the hydrocyclone unit. The width of the second chamber section measured where the fluid is injected into the second chamber section is smaller than the width of the first chamber section, preferably 65 to 100% of the width of the first chamber section, measured where the suspension is fed into the first chamber section. The width of the first chamber section at the apex is 50 to 75% of the width of the first chamber section measured where the suspension is fed into the first chamber section, and the length of the first chamber section is 5 to 9 times the width of the first chamber section also measured where the suspension is fed into the first chamber section.

The fluid injection member may inject a liquid, or a mixture of liquid and gas. An advantage of injecting a mixture of liquid and gas is that the gas mechanically dissolves fibre network occurring in the second chamber section. Advantageously, the injected fluid may be a fibre suspension having a fibre concentration lower than that of the fibre suspension to be fed by the inlet member.

The first and second chamber sections are suitably positioned relative to each other, such that their central symmetry axes intersect with each other. Alternatively, the first and second chamber sections may be aligned with each other. Generally, the axial opening at the apex end of the first chamber section forms the axial opening at the base end of the second chamber section.

In accordance with a first alternative embodiment of the invention, the second chamber section includes an injection passage at the base end of the second chamber section for receiving the fluid injected by the injection member, wherein the width of the injection passage expands along the injection passage, in the direction towards the apex end of the second chamber section.

In accordance with a second alternative embodiment of the invention, the base end of the second chamber section is wider than the apex end of the first chamber section, and the opening of the apex end of the first chamber section forms the opening of the base end of the second chamber section, whereby the width of the separation chamber abruptly increases where the first chamber section passes to the second chamber section.

In accordance with a third alternative embodiment of the invention, the housing forms a tubular wall defining the first chamber section, and a portion of the tubular wall extends into the second chamber section such that the axial opening at the apex end of the first chamber section is situated in the second chamber section, whereby said portion of the tubular wall functions as a vortex finder in the second chamber section. The second chamber section includes an injection passage at the base end of the second chamber section for receiving the fluid injected by the injection member, and said portion of the tubular wall extends past said injection passage. In this embodiment, the width of the apex end of the first chamber section is 30-60% of the width of the first chamber section measured where the suspension is fed into the first chamber section and is not greater than 90% of the width of the second chamber section measured where the fluid is injected into the injection passage of the second chamber section.

Although the embodiments of the invention described above only include two separate chamber sections of the separation chamber it is possible to arrange three or more chamber sections provided with two or more fluid injection members. There may be two or more fluid injection members for each chamber section located at the same axial level relative to the elongate separation chamber and circumferentially spaced from one another. For example, the housing may be provided with two fluid injection members circumferentially spaced 180° relative to each other for injecting the fluid in the second chamber section.

At least one hydrocyclone unit of the invention described above is advantageously used in a hydrocyclone plant that includes at least two stages of hydrocyclones, a first stage of a plurality of hydrocyclones coupled in parallel and a second stage of a plurality of hydrocyclones coupled in parallel. The two stages of hydrocyclones are coupled in cascade and at least one of the hydrocyclones in at least the first stage comprises said hydrocyclone unit. Each of the hydrocyclones in at least the first stage of the hydrocyclone plant preferably comprises said hydrocyclone unit.

The present invention also relates to a method of separating a fibre pulp suspension containing relatively heavy contaminants. The method comprises:

a) providing an elongate generally tapering separation chamber having an open base end and an open apex end, b) feeding the suspension tangentially into the separation chamber at the base end thereof to form a vortex, in which the heavy contaminants are pulled by centrifugal forces radially outwardly and the fibres are pushed by drag forces radially inwardly, so that a central fraction of the suspension substantially containing fibres is created centrally in the vortex and a reject fraction containing heavy contaminants and some fibres is created radially outwardly in the separation chamber, c) injecting a fluid tangentially into the separation chamber at a distance from the apex end of the separation chamber which is at least 40% of the length of the separation chamber, so that the injected fluid increases the rotational speed of a portion of the vortex in the chamber to increase the separation efficiency with respect to fibres existing in said vortex portion, d) discharging the created central fraction through the open base end of the separation chamber, and e) discharging the created reject fraction from the apex end of the separation chamber.

The method of the invention further comprises:

f) providing a first elongate generally tapering chamber section of the separation chamber extending from the base end of the separation chamber to an apex end of the first chamber section having an axial opening and a second elongate generally tapering chamber section of the separation chamber extending from a base end thereof having an axial opening to the apex end of the separation chamber, g) providing communication between the first chamber section and the second chamber section, so that the vortex extends from the first chamber section through the axial opening of the apex end of the first chamber section and the axial opening of the base end of the second chamber section into the second chamber section, and h) injecting the fluid tangentially into the second chamber section at the base end thereof to increase the rotational speed of the vortex existing in the second chamber section.

Step (c) may be performed by injecting a liquid, or a mixture of liquid and gas. For example, step (c) may be performed by dividing a part flow of the fibre suspension fed into the first separation chamber and injecting said part flow of fibre suspension as said fluid into the second separation chamber.

The first and second elongate tapering chamber sections may be designed in accordance with the design of the hydrocyclone unit of the invention described above.

The hydrocyclone unit of the invention described above is of the type known in the pulp and paper making industry as a forward hydrocyclone, in which the fibre containing accept fraction is discharged through the base end of the separation chamber and the heavy contaminants containing reject fraction is discharged through the apex and of the separation chamber. However, the hydrocyclone unit of the present invention may alternatively be of the type known in the pulp and paper making industry as a reverse hydrocyclone, in which the fibre suspension is cleaned from light contaminants. The reverse hydrocyclone is operated so that the fibre containing accept fraction discharges through the apex end of the separation chamber and the light contaminants containing reject fraction discharges through the base end of the separation chamber.

Accordingly, in accordance with an alternative aspect of the present invention, the invention provides a reverse hydrocyclone unit for separating a fibre pulp suspension containing relatively light contaminants, comprising a housing forming an elongate tapering separation chamber having a base end and an apex end, a suspension inlet member on the housing designed to feed the suspension to be separated tangentially into the separation chamber at the base end thereof, such that the incoming suspension forms a vortex, in which the fibres are pulled by centrifugal forces radially outwardly and the light contaminants are pushed by drag forces radially inwardly, whereby a central reject fraction of the suspension containing light contaminants and some fibres is created centrally in the vortex and an accept fraction substantially containing fibres is created radially outwardly in the separation chamber, an accept fraction outlet at the apex end of the separation chamber for discharging the accept fraction, a central reject fraction outlet at the base end of the separation chamber for discharging the central reject fraction, and at least one fluid injection member for injecting a fluid into the separation chamber. The reverse hydrocyclone unit is characterised in that the fluid injection member is adapted to inject the fluid tangentially into the separation chamber at a distance from the apex end of the separation chamber which is at least 40% of the length of the separation chamber, such that the injected fluid increases the rotational speed of a portion of the vortex in the chamber to increase the separation efficiency with respect to fibres existing in said vortex portion.

The present invention also provides an alternative method of separating a fibre pulp suspension containing relatively light contaminants, comprising:

a) providing an elongate tapering separation chamber having an open base end and an open apex end, b) feeding the suspension tangentially into the separation chamber at the base end thereof to form a vortex, in which the fibres are pulled by centrifugal forces radially outwardly and the light contaminants are pushed by drag forces radially inwardly, so that a central reject fraction of the suspension containing light contaminants and some fibres is created centrally in the vortex and an accept fraction substantially containing fibres is created radially outwardly in the separation chamber, c) injecting a fluid tangentially into the separation chamber at a distance from the apex end of the separation chamber which is at least 40% of the length of the separation chamber, so that the injected fluid increases the rotational speed of a portion of the vortex in the chamber to increase the separation efficiency with respect to fibres existing in said vortex portion, d) discharging the created central reject fraction through the open base end of the separation chamber, and e) discharging the created accept fraction from the apex end of the separation chamber.

DETAILED DESCRIPTION OF THE INVENTION

Figure 1:
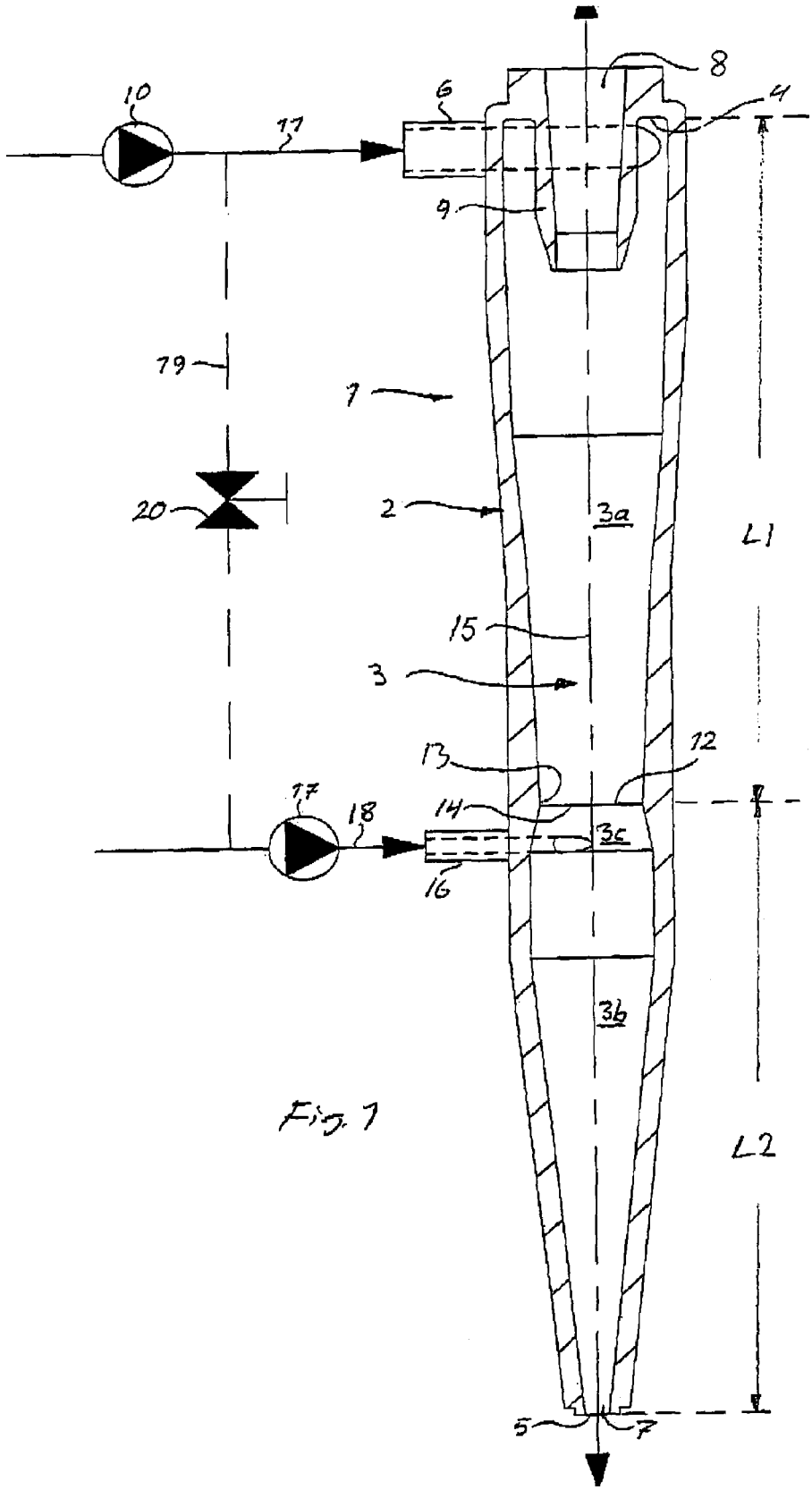
FIG. 1 is a schematic cross-sectional view of an embodiment of the hydrocyclone unit of the invention.

Referring to the drawing figures, like reference numerals designate identical or corresponding elements throughout the several figures.

FIG. 1 shows a hydrocyclone unit 1 of the invention, which comprises a housing 2 that forms an elongate generally tapering separation chamber 3 with a base end 4 and an apex end 5. An inlet member 6 is provided on the housing 2 and designed to feed a fibre suspension to be separated tangentially into the separation chamber 3 at the base end 4 thereof. There are a reject fraction outlet 7 at the apex end 5 of the separation chamber 3 for discharging a created reject fraction of the suspension and a central accept fraction outlet 8, defined by a conventional vortex finder 9, at the base end 4 of the separation chamber 3 for discharging a created central fraction of the suspension.

In operation, a pump 10 pumps a fibre suspension containing heavy contaminants through a conduit 11 to the inlet member 6, which feeds the suspension tangentially into the separation chamber 3. The incoming suspension forms a vortex, in which the heavy contaminants are pulled by centrifugal forces radially outwardly and the fibres are pushed by drag forces radially inwardly. As a result a central fraction of the suspension substantially containing fibres is created centrally in the vortex and a reject fraction containing heavy contaminants and some fibres is created radially outwardly in the separation chamber. The created reject fraction is discharged through the reject fraction outlet 7 and the created central fraction is discharged through the central accept fraction outlet 8.

The housing 2 forms a first elongate generally tapering chamber section 3*a* of the separation chamber 3 extending from the base end 4 of the separation chamber 3 to an apex end 12 of the first chamber section 3*a* having an axial opening 13 and a second elongate generally tapering chamber section 3*b* of the separation chamber 3 extending from a base end 14 thereof to the apex end 5 of the separation chamber 3. The axial opening 13 of the apex end 12 of the first chamber section 3*a* also forms an opening to the second chamber section 3*b* at the base end 14 thereof. The first and second chamber sections 3*a*, 3*b* are aligned with each other, so that their central symmetry axes form a common central symmetry axis 15. The vortex formed in the separation chamber 3 during operation extends from the first chamber section 3*a* through the axial opening 13 of the apex end 12 of the first chamber section 3*a* into the second chamber section 3*b*.

An injection member 16 is provided on the housing 2 to inject a liquid tangentially into the separation chamber 3 at a distance from the apex end 5 of the separation chamber 3, which is at least 40% of the length of the separation chamber 3. In the embodiment of FIG. 1 the second chamber section 3*b* includes an injection passage 3*c* at the base end 14 of the second chamber section 3*b* for receiving the liquid injected by the injection member 16. The width of the injection passage 3*c* expands along the injection passage 3*c* in the direction towards the apex end 5 of the separation chamber.

In operation, a pump 17 pumps liquid through a conduit 18 to the injection member 16, which injects the liquid tangentially into the second chamber section 3*b* so that the injected liquid increases the rotational speed of a portion of the vortex in the chamber section 3*b*, thereby increasing the separation efficiency with respect to fibres existing in said vortex portion. As indicated in a broken line 19 in FIG. 1, a part flow of the fibre suspension conducted through the conduit 11 may optionally be directed via an adjustable valve 20 to the conduit 18.

The length L1 of the first chamber section 3*a* is about 60 cm and the length L2 of the second chamber section is about 50 cm. The width of the second chamber section 3*b* measured where the liquid is injected is about 6 cm and the width of the first chamber section 3*a* where the suspension is fed is about 8 cm.

Generally, the length L1 of the first chamber section 3*a* should be 5 to 9 times the width of the first chamber section 3*a* also measured where the suspension is fed into the first chamber section. The width of the second chamber section 3*b* measured where the liquid is injected should be equal to or smaller than the width of the first chamber section, preferably 65 to 100% of the width of the first chamber section, measured where the suspension is fed into the first chamber section. The width of the first chamber section at the apex should be 50 to 75% of the width of the first chamber section measured where the suspension is fed into the first chamber section.

Figure 2:
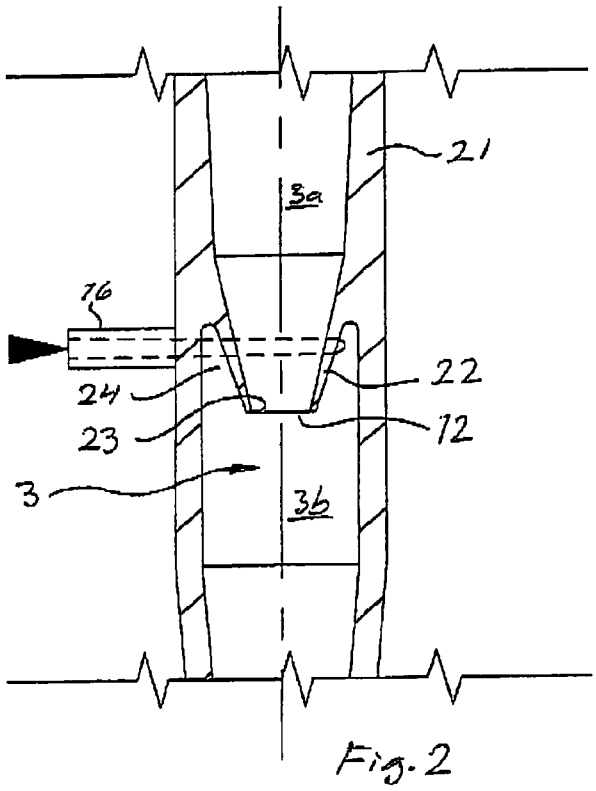
FIGS. 2 and 3 are modifications of the embodiment shown in FIG. 1, FIG. 4 schematically illustrates a five-stage hydrocyclone plant employing conventional hydrocyclones, and FIG. 5 schematically illustrates a three-stage hydrocyclone plant employing hydrocyclones units of the invention having the same capacity as the conventional plant shown in FIG. 4.

FIG. 2 shows a modification of the embodiment according to FIG. 1, wherein the housing 2 forms a tubular wall 21 defining the first chamber section 3*a*, and a portion 22 of the tubular wall 21 extends into the second chamber section 3*b* so that an axial opening 23 at the apex end 12 of the first chamber section 3*a* is situated in the second chamber section 3*b*, whereby the portion 22 of the tubular wall 21 functions as a vortex finder in the second chamber section 3*b*. The second chamber section 3*b* includes an injection passage 24 at the base end of the second chamber section 3*b* for receiving the liquid injected by the injection member 16. The portion 22 of the tubular wall 21 extends past the injection passage 24. In this embodiment, the width of the first chamber section 3*a* at the apex end 12 should be 30-60% of the width of the first chamber section 3*a* measured where the suspension is fed into the first chamber section 3*a* and should not be greater than 90% of the width of the second chamber section 3*b* measured where the fluid is injected into the injection passage 24.

Figure 3:
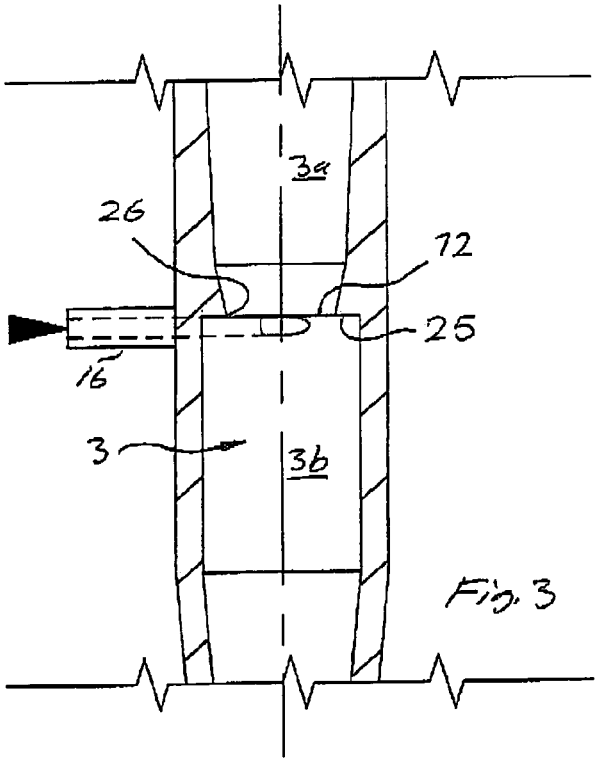

FIG. 3 shows another modification of the embodiment according to FIG. 1, wherein the second chamber section 3*b* has a base end 25 that is wider than the apex end 12 of the first chamber section 3*a*, and an opening 26 of the apex end 12 of the first chamber section 3*a* forms the opening of the base end 25 of the second chamber section 3*b*. As a result, the width of the separation chamber 3 abruptly increases where the first chamber section 3*a* passes to the second chamber section 3*b*.

Figure 4:
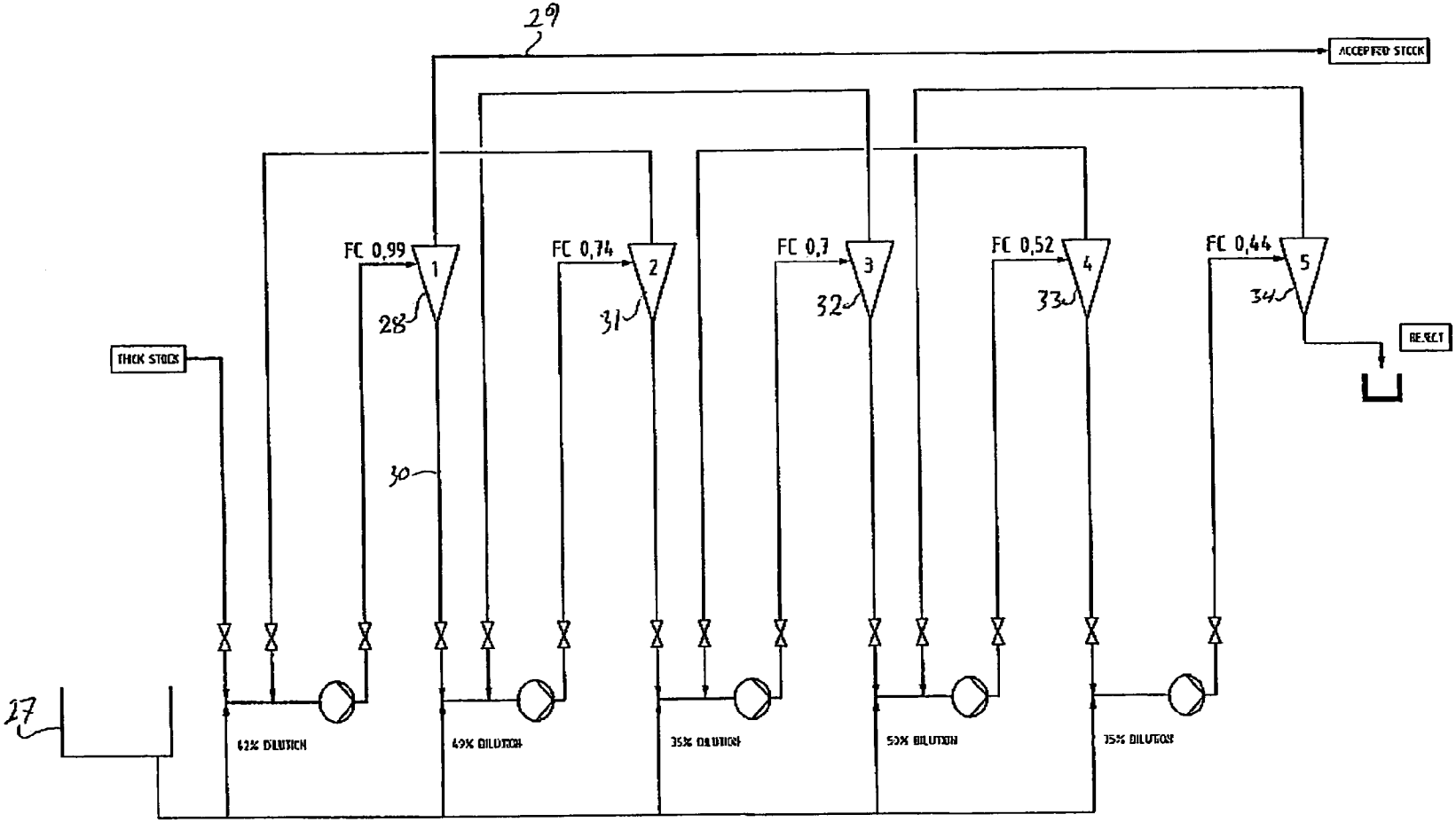

FIG. 4 schematically illustrates a typical five-stage hydrocyclone plant employing conventional hydrocyclones. The hydrocyclones of the five stages are coupled in cascade, i.e. the accept fraction developed in any one of the second to fifth stages is conducted to the feed inlet of the adjacent foregoing stage. A fibre pulp of medium CSF (Canadian Standard Freeness) is treated in the plant to clean the fibre pulp from heavy contaminants. The fibre pulp is diluted with water supplied by a water tank 27 to form a fibre suspension having a fibre concentration (FC) of 0.99% in weight. The first stage 28 includes 62 conventional hydrocyclones that are fed with the suspension at a flow of 38000 litre/minute. In the first stage 28 the suspension separates into an accept fibre fraction that is discharged from the plant through a conduit 29 and a reject fraction containing heavy contaminants and fibres discharged through a conduit 30.

The reject rate in weight developed in the first stage 28 constitutes 22% of the suspension flow fed to the first stage 28 and contains a substantial amount of fibres that has to be recovered. This requires four further hydrocyclones stages as illustrated in FIG. 4, wherein the second 31, third 32, fourth 33 and fifth 34 stages include twenty-two hydrocyclones, seven hydrocyclones, three hydrocyclones and one hydrocyclone, respectively. Thus, the conventional plant shown in FIG. 4 requires ninety-five conventional hydrocyclones. The specific power consumption of the conventional plant is 13.8 kWh/ton.

Figure 5:
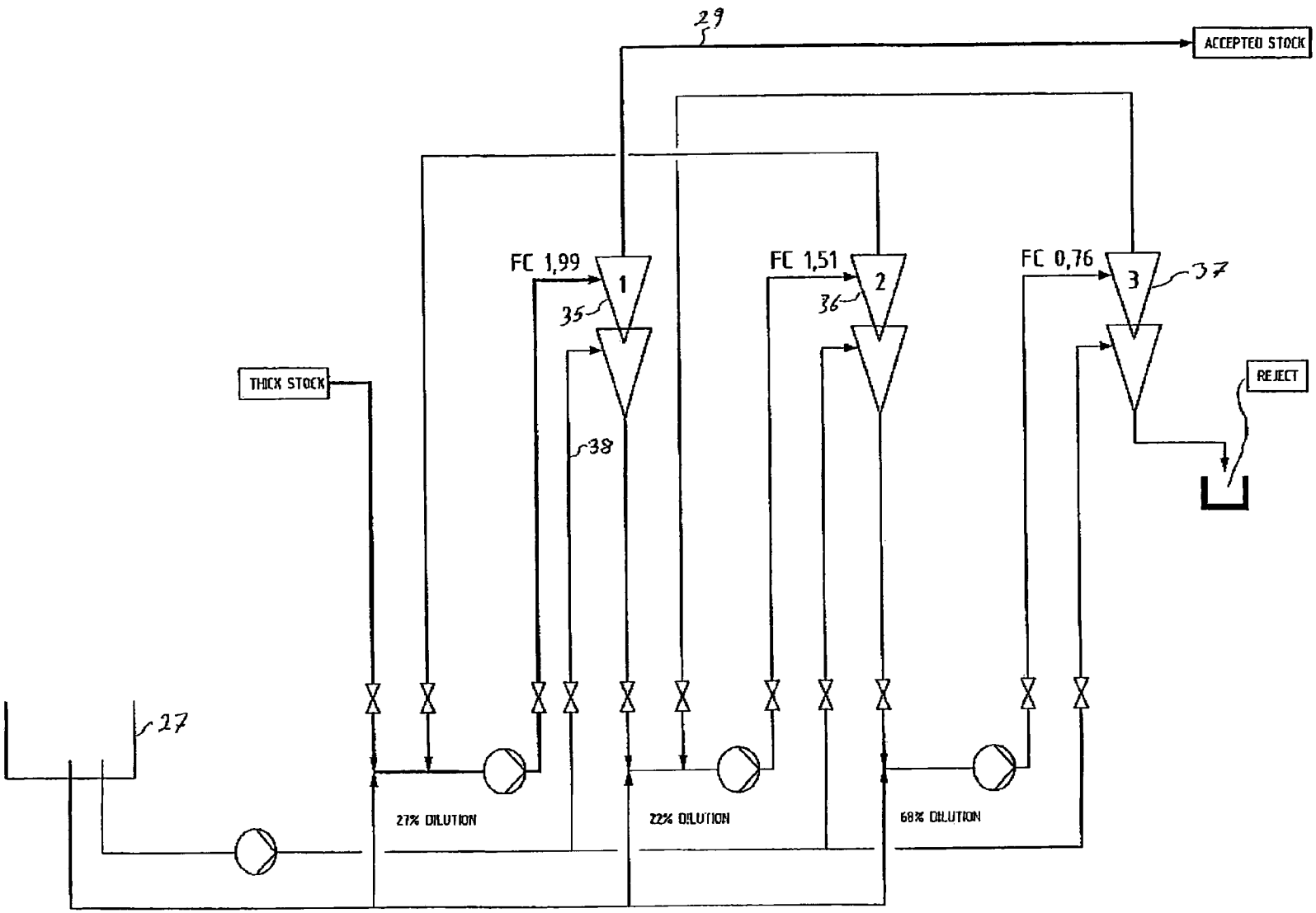

FIG. 5 schematically illustrates an example of a new three-stage hydrocyclone plant employing hydrocyclone units (1) of the present invention and having the same production capacity as that of the conventional plant illustrated in FIG. 4. The fibre pulp (medium CSF) is diluted with water from the water tank 27 to form a fibre suspension having a fibre concentration (FC) of 1.99% in weight. The first stage 35 includes twenty-seven hydrocyclone units that are fed with the suspension at a flow of 17000 litre/minute. Injection liquid in the form of water, white water or fibre suspension is injected into the separation chamber of the respective hydrocyclone units. Here, the injection liquid is in the form of water supplied from the water tank 27 through a conduit 38. The reject rate in weight developed in the first stage 35 constitutes 10% of the suspension flow fed to the first stage 35. Only two further hydrocyclones stages including hydrocyclone units 1 of the invention are required to recover the fibres in the reject fraction that leaves the first stage 35, wherein the second stage 36 and third stage 37 include four hydrocyclone units 1 and one hydrocyclone unit 1, respectively. Thus, the new plant requires only 32 hydrocyclone units 1 (ninety-five hydrocyclones for the conventional plant). The specific power consumption of the new plant is less than 5 kWh/ton (13.8 for the conventional plant).

The above comparison between a conventional hydrocyclone plant as illustrated in FIG. 4 and a new plant employing hydrocyclone units of the invention as illustrated in FIG. 5 emphasizes the significant advance in the art of the present invention.

What is claimed is:

1. A hydrocyclone unit for separating a fibre pulp suspension containing relatively heavy contaminants, comprising:

a housing forming an elongate tapering separation chamber having a base end and an apex end, at least one suspension inlet member on the housing designed to feed the suspension to be separated tangentially into the separation chamber at the base end thereof, such that the incoming suspension forms a vortex, in which the heavy contaminants are pulled by centrifugal forces radially outwardly and the fibres are pushed by drag forces radially inwardly, whereby a central fraction of the suspension substantially containing fibres is created centrally in the vortex and a reject fraction containing heavy contaminants and some fibres is created radially outwardly in the separation chamber, one and only one reject fraction outlet for discharging the reject fraction from the separation chamber, the reject fraction outlet being axially situated at the apex end of the separation chamber, a central accept fraction outlet at the base end of the separation chamber for discharging the central fraction, and at least one fluid injection member for injecting a new fluid into the separation chamber, wherein the fluid injection member injects the new fluid tangentially into the separation chamber at a distance from the apex end of the separation chamber which is at least 40% of the length of the separation chamber, such that the injected new fluid increases the rotational speed of a portion of the vortex in the separation chamber to increase the separation efficiency with respect to fibres existing in said vortex portion.

2. A hydrocyclone unit according to claim 1, wherein the housing forms a first elongate generally tapering chamber section of the separation chamber extending from the base end of the separation chamber to an apex end of the first chamber section having an axial opening and a second elongate generally tapering chamber section of the separation chamber extending from a base end thereof having an axial opening to the apex end of the separation chamber, the first chamber section communicates with the second chamber section, such that the vortex formed in the separation chamber during operation extends from the first chamber section through the axial opening of the apex end of the first chamber section and the axial opening of the base end of the second chamber section into the second chamber section, and the fluid injection member is designed to inject the fluid tangentially into the second chamber section at the base end thereof to increase the rotational speed of a portion of the vortex existing in the second chamber section.

3. A hydrocyclone unit according to claim 2, wherein the length of the second chamber section is at least 60% of the length of the first chamber section.

4. A hydrocyclone unit according to claim 2, wherein the width of the second chamber section measured where the fluid is injected into the second chamber section is equal to or smaller than the width of the first chamber section measured where the suspension is fed into the first chamber section.

5. A hydrocyclone unit according to claim 2, wherein the width of the first chamber section at the apex end is 50 to 75% of the width of the first chamber section measured where the suspension is fed into the first chamber section.

6. A hydrocyclone unit according to claim 2, wherein the length of the first chamber section is 5 to 9 times the width of the first chamber section measured where the suspension is fed into the first chamber section.

7. A hydrocyclone unit according to claim 1, wherein the fluid injection member is adapted to inject a liquid, or a mixture of liquid and gas.

8. A hydrocyclone unit according to claim 7, wherein the fluid to be injected is a fibre suspension, the fibre concentration of which is lower or equal than that of the fibre suspension to be fed by the inlet member.

9. A hydrocyclone unit according to claim 2, wherein the first and second chamber sections are positioned relative to each other, such that their central symmetry axes intersect with each other.

10. A hydrocyclone unit according to claim 2, wherein the first and second chamber sections are aligned with each other.

11. A hydrocyclone unit according to claim 9, wherein the second chamber section includes an injection passage at the base end of the second chamber section for receiving the fluid injected by the injection member, the width of the injection passage expanding along the injection passage in the direction towards the apex end of the separation chamber.

12. A hydrocyclone unit according to claim 9, wherein the a base end of the second chamber section is wider than the an apex end of the first chamber section, and the opening of the apex end of the first chamber section forms the opening of the base end of the second chamber section, whereby the width of the separation chamber abruptly increases where the first chamber section passes to the second chamber section.

13. A hydrocyclone unit according to claim 11, wherein the width of the second chamber section measured where the fluid is injected into the second chamber section is 65 to 100% of the width of the first chamber section measured where the suspension is fed into the first chamber section.

14. A hydrocyclone unit according to claim 9, wherein the housing forms a tubular wall defining the first chamber section, and a portion of the tubular wall extends into the second chamber section such that the axial opening at the apex end of the first chamber section is situated in the second chamber section, whereby said portion of the tubular wall functions as a vortex finder in the second chamber section.

15. A hydrocyclone unit according to claim 14, wherein the second chamber section includes an injection passage at the base end of the second chamber section for receiving the fluid injected by the injection member, and a portion of the tubular wall extends past said injection passage.

16. A hydrocyclone unit according to claim 15, wherein the width of the apex end of the first chamber section is 30-60% of the width of the first chamber section measured where the suspension is fed into the first chamber section and is not greater than 90% of the width of the second chamber section measured where the fluid is injected into the injection passage of the second chamber section.

17. A hydrocyclone plant that includes at least two stages of hydrocyclones, a first stage of a plurality of hydrocyclones coupled in parallel and a second stage of a plurality of hydrocyclones coupled in parallel, wherein the two stages of hydrocyclones are coupled in cascade and at least one of the hydrocyclones in at least the first stage comprises a hydrocyclone unit as claimed in claim 1.

18. A hydrocyclone plant according to claim 17, wherein each of the hydrocyclones in at least the first stage of the hydrocyclone plant comprises said hydrocyclone unit.

19. A reverse hydrocyclone unit for separating a fibre pulp suspension containing relatively light contaminants, comprising:

a housing forming an elongate tapering separation chamber having a base end and an apex end, at least one suspension inlet member on the housing designed to feed the suspension to be separated tangentially into the separation chamber at the base end, such that the incoming suspension forms a vortex, in which the fibres are pulled by centrifugal forces radially outwardly and the light contaminants are pushed by drag forces radially inwardly, whereby a central fraction of the suspension substantially containing the light contaminants and some of the fibres is created centrally in the vortex, and an accept fraction substantially containing fibres is created radially outwardly in the separation chamber for discharging the accept fraction, a central reject fraction outlet at the base end of the separation chamber for discharging the central fraction, and at least one fluid injection member for injecting a fluid into the separation chamber.

20. A reverse hydrocyclone unit according to claim 19, wherein the fluid injection member is adapted to inject the fluid tangentially into the separation chamber at a distance from the apex end of the separation chamber which is at least 40% of the length of the separation chamber, such that the injected fluid increases the rotational speed of a portion of the vortex in the chamber to increase the separation efficiency.

21. A reverse hydrocyclone unit according to claim 19, wherein there is one and only one accept fraction outlet for discharging the accept fraction from the separation chamber, the accept fraction outlet being axially situated at the apex end of the separation chamber.

22. A reverse hydrocyclone unit according to claim 19, wherein the at least one fluid injection member for injects a new fluid into the separation chamber.

23. A reverse hydrocyclone unit according to claim 19, wherein the housing forms a first elongate generally tapering chamber section of the separation chamber extending from the base end of the separation chamber to an apex end of the first chamber section having an axial opening and a second elongate generally tapering chamber section of the separation chamber extending from a base end thereof having an axial opening to the apex end of the separation chamber, the first chamber section communicates with the second chamber section, such that the vortex formed in the separation chamber during operation extends from the first chamber section through the axial opening of the apex end of the first chamber section and the axial opening of the base end of the second chamber section into the second chamber section, and the fluid injection member is designed to inject the fluid tangentially into the second chamber section at the base end thereof to increase rotational speed of a portion of the vortex existing in the second chamber section.

24. A reverse hydrocyclone unit according to claim 23, wherein a length of the second chamber section is at least 60% of a length of the first chamber section.

* * * * *